US012151141B1

(12) United States Patent
Coates et al.

(10) Patent No.: US 12,151,141 B1
(45) Date of Patent: Nov. 26, 2024

(54) FOLDING GRAPPLING HOOK

(71) Applicant: Sherrill, Inc., Greensboro, NC (US)

(72) Inventors: Reg Coates, Victoria (CA); Micah Heanssler, Windham, ME (US)

(73) Assignee: Sherrill, Inc., Greensboro, NC (US)

( * ) Notice: Subject to any disclaimer, the term of this patent is extended or adjusted under 35 U.S.C. 154(b) by 0 days.

(21) Appl. No.: 18/760,155

(22) Filed: Jul. 1, 2024

(51) Int. Cl.
*A63B 27/00* (2006.01)

(52) U.S. Cl.
CPC ..... *A63B 27/00* (2013.01)

(58) Field of Classification Search
CPC ..... A63B 27/00
See application file for complete search history.

(56) References Cited

U.S. PATENT DOCUMENTS 567,493 A * 9/1896 McCartea ..... A01L 11/00 168/48.1
651,724 A * 6/1900 Peterson ..... B63B 21/243 114/302
2,814,108 A * 11/1957 Bassett ..... B25F 1/04 30/152
6,474,441 B1 11/2002 Bertolino
7,240,937 B2 7/2007 Wooten et al.
10,265,554 B2 4/2019 Colorado
2004/0032139 A1* 2/2004 Wooten ..... F41H 11/12 294/82.1
2011/0232994 A1 9/2011 Broyles
2015/0067968 A1* 3/2015 Eckert ..... A63B 29/02 7/168
2016/0317849 A1 11/2016 Cowell et al.
2019/0022437 A1* 1/2019 Kekahuna ..... F16B 45/028
2023/0065216 A1 3/2023 Wood et al.

FOREIGN PATENT DOCUMENTS

CN 201263851 Y 7/2009

* cited by examiner

*Primary Examiner* — Stephen A Vu
(74) *Attorney, Agent, or Firm* — Altman & Martin; Steven K. Martin

(57) ABSTRACT

A folding grappling hook has a blade and a handle. The blade has a hinge end and a hook at the other end. The handle has two plates sandwiching a long spacer and a short spacer, the spacers forming an aperture bounded by the plates, long spacer, and short spacer. The blade and handle are attached at a hinge so that they freely pivot relative to each other between a closed configuration where the hook is sheathed within the aperture and a deployed configuration where the blade is pivoted out of the handle to a deployed stop. In the deployed stop, a finger on the long spacer engages a circumferential groove in the blade, and as the blade pivots away from the handle, the groove rotates until the finger contacts the end of the groove.

13 Claims, 9 Drawing Sheets

FOLDING GRAPPLING HOOK

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to arborist tools, more particularly, to grappling hooks for moving around in trees.

2. Description of the Related Art

Current grappling hooks, such as the throwing hook described in US Patent Publication No. US2016/0317849, are rigid. These do not allow for easy storage on one's person while working at height. They have a relatively small hook opening, limiting the size of the branch or bar that it can hook onto. The design does not have a way to retrieve the hook without the hook becoming entangled again.

BRIEF SUMMARY OF THE INVENTION

The present invention is a folding grappling hook that folds into itself when not in use. The folding grappling hook has a blade and a handle. The blade has a slightly inwardly curved body with a rounded hinge end and a hook end. The hook end is curved inwardly in the range of 60° to 120° to form a hook.

The handle is slightly curved inwardly toward the blade, has an attachment end and a rounded hinge end, and an A side plate and a B side plate that are mirror images of each other. A long spacer has a stop end and an aperture end. The long spacer is sandwiched between the two plates with the stop end extending toward the handle hinge end. Rivets permanently secure the handle together. A short spacer is a hollow cylinder that is sandwiched between the two plates and is removably secured in place. It is positioned adjacent to the attachment end so that there is an aperture bounded by the plates, the aperture end of the long spacer, and the short spacer.

The blade is attached to the handle at a hinge so that they freely pivot relative to each other. In one hinge mechanism, a pair of axially aligned circular collars extend perpendicularly in opposite directions from the blade body adjacent to the hinge end. Prior to installing the rivets, the blade collars are inserted into round hinge holes in the plates. When the rivets are installed, the collars are captured in the hinge holes to form the hinge. In another hinge mechanism, the collars are on the plates and are captured in a hole in the blade. In another hinge mechanism, a collar extends from one plate through holes in the blade and other plate. Other hinge mechanisms use press fit rods through holes in the plates and blade.

The blade pivots between a closed configuration at a folding stop and a deployed configuration at a deployed stop. In the closed configuration, the hook is sheathed within the aperture. The hook is slightly narrower than the aperture and the body. The discontinuity between the hook and the body forms a shoulder that contacts the two plates to operate as the folding stop.

In the deployed configuration, the blade is pivoted out of the handle to an angle in the range of from 40° to 90°, with a preferred range of 50° to 65° and a preferred angle of about 55°. The deployed stop prevents the blade from pivoting further than desired from the handle. A finger from the stop end of the long spacer engages a circumferential groove in the hinge end of the blade. As the blade pivots away from the handle, the groove rotates relative to the finger until the finger end contacts the end of the groove, thereby operating as the deployed stop.

A line is attached to the folding grappling hook at an attachment at the attachment end of the handle. When deploying, the folding grappling hook with the line attached is thrown to fly through the tree canopy in the closed configuration. Once the folding grappling hook has landed on a tree branch, it unfolds to the deployed configuration by its own weight and snags on the branch. To retrieve, the line is twisted until the folding grappling hook flips on its back and folds together under its own weight.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present invention is a folding grappling hook 10 for propelling a climbing line into a tree or similar structure. The folding grappling hook 10 folds into itself, like a pocketknife, when not in use.

As seen in FIGS. 1-4, the folding grappling hook 10 has two main parts, a blade 12 and a handle 14.

Figure 9:
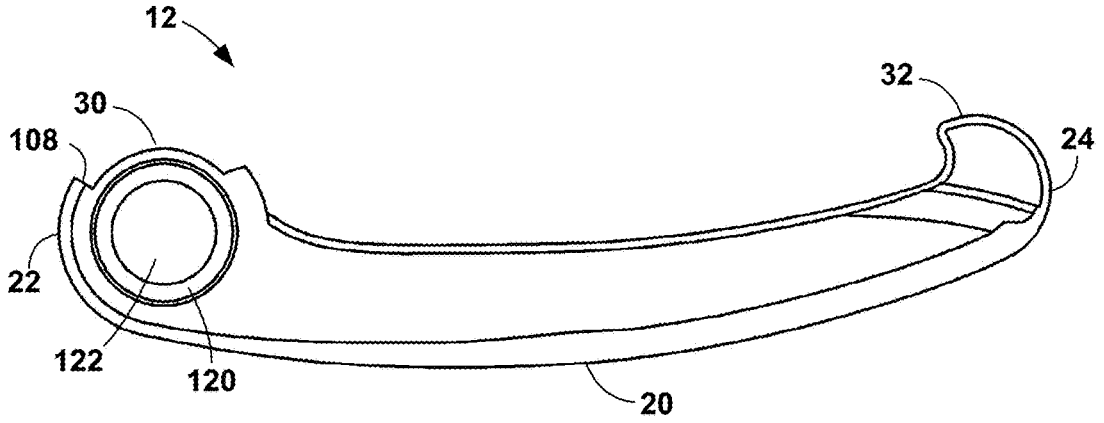
FIG. 9 is a side view of the blade.
Figure 10:
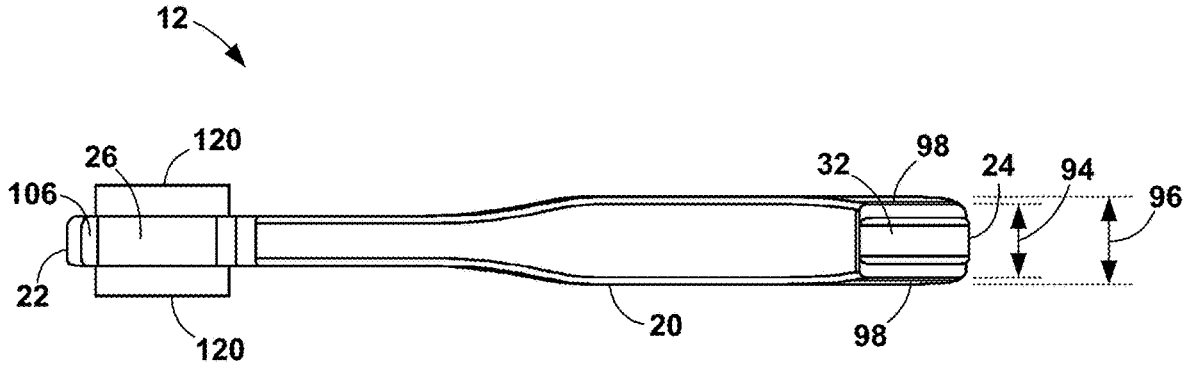
FIG. 10 is an inside view of the blade.

The blade 12, shown in FIGS. 9 and 10, has a slightly inwardly curved body 20 (relative to the closed grappling hook 10, see FIG. 3) with a rounded hinge end 22 and a hook end 24. The rounded hinge end 22 has a circumferential groove 26 in the perimeter, the details of which are described below.

The hook end 24 is curved inwardly to form a hook 28. In the illustrated embodiment, the hook end 24 is curved inwardly approximately 90°. The present invention contemplates that the curve can be in the range of 60° to 120°.

Figure 5:
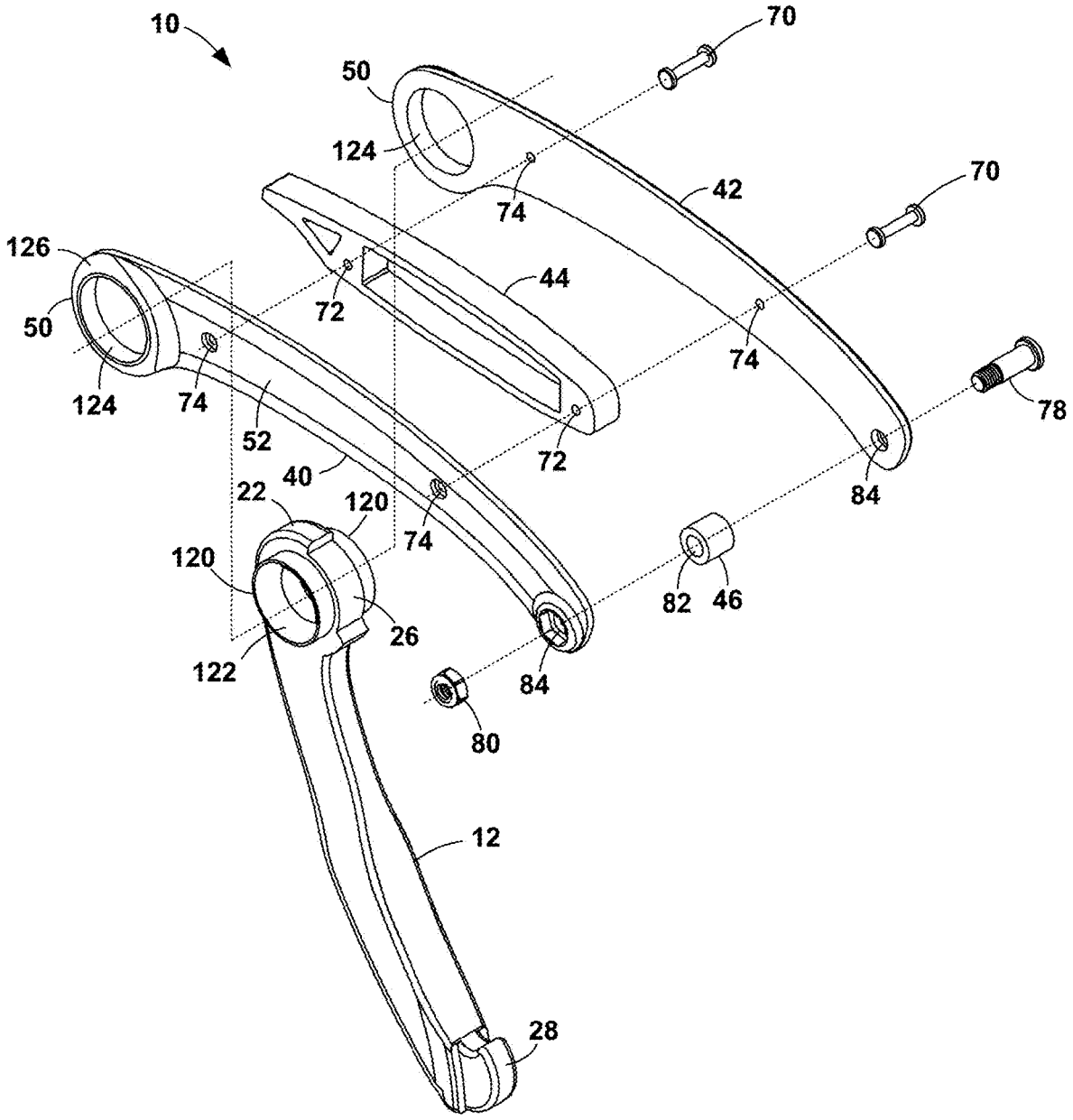
FIG. 5 is an exploded, perspective view of the folding grappling hook with a first configuration of the hinge.
Figure 11:
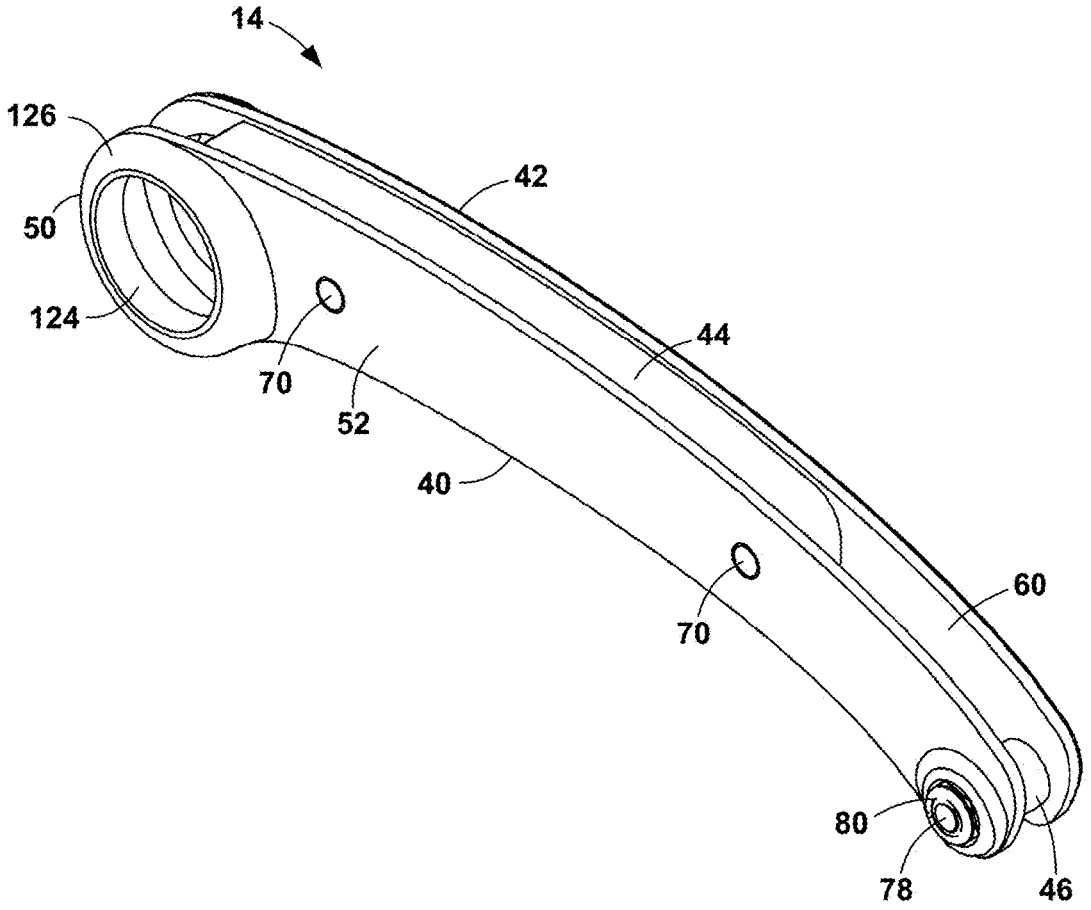
FIG. 11 is an assembled, perspective view of the handle.

As shown in FIGS. 5 and 11, the handle 14 has an attachment end 48 and a rounded hinge end 50, and is comprised of an A side plate 40, a mirror image B side plate 42, a long spacer 44, a short spacer 46, and assembly hardware. The handle 14 is slightly curved inwardly toward the blade 12.

Figure 12:
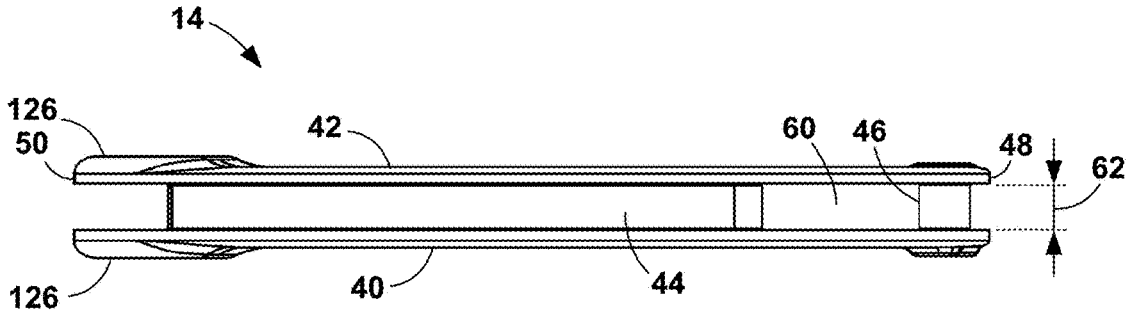
FIG. 12 is an assembled, top view of the handle.

The long spacer 44, shown in FIG. 12, has a stop end 64 and an aperture end 66. The long spacer 44 is sandwiched between the two plates 40, 42, as in FIG. 11, with the stop end 64 extending toward the hinge end 50 as described below. Rivets 70 extend through holes 72 at each end of the long spacer 44 and aligned holes 74 in the plates 40, 42 to permanently secure the handle 14 together, where "permanently" means that the handle 14 cannot be taken apart without destruction of either the plates 40, 42, the long spacer 44, or the rivets 70. Preferably, the plate holes 74 are countersunk for the rivet heads so that the folding grappling hook 10 maintains a streamlined profile.

Figure 6:
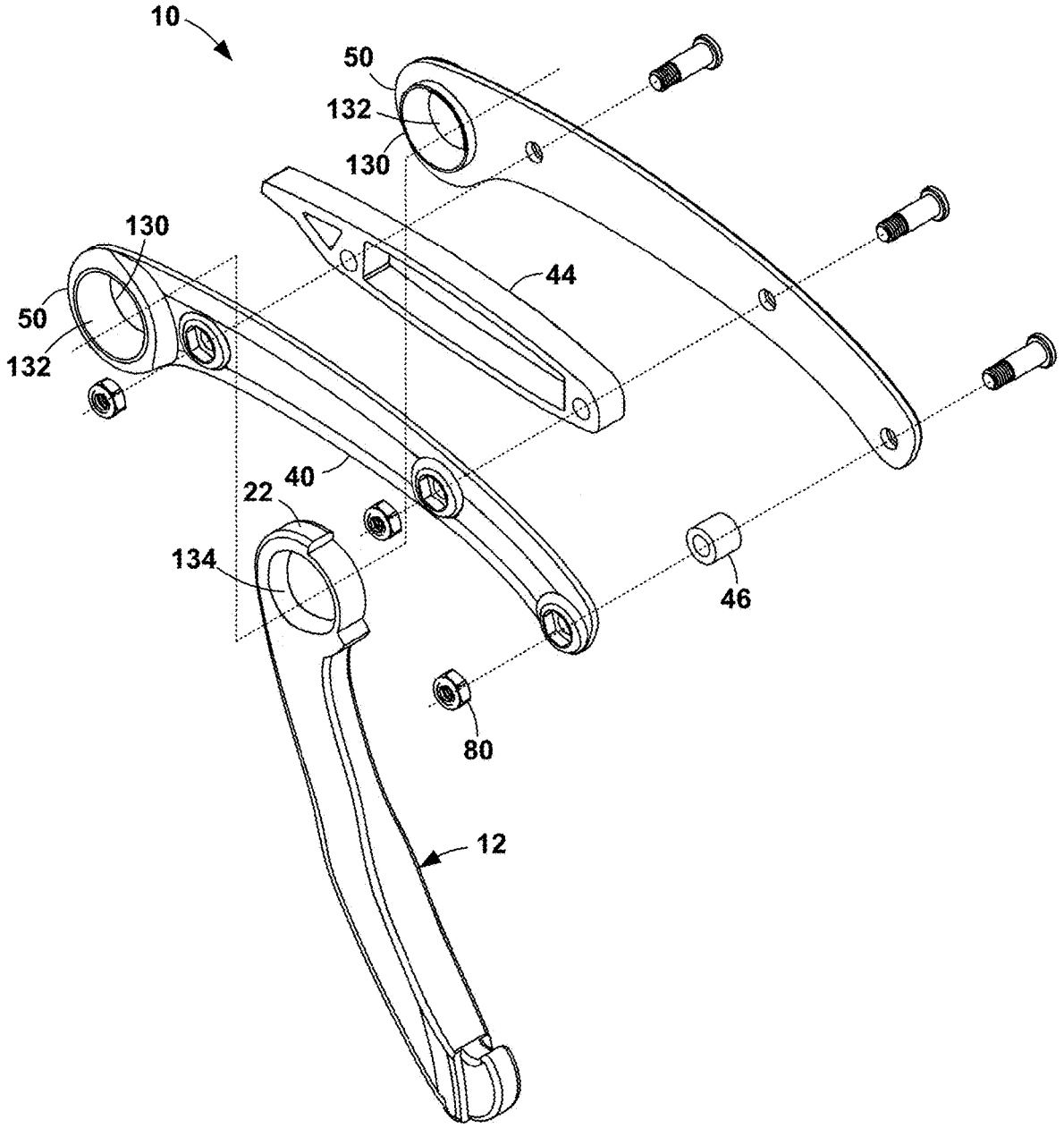
FIG. 6 is an exploded, perspective view of the folding grappling hook with a second configuration of the hinge.

Alternatively, the plates 40, 42 and the long spacer 44 are removably secured together by, for example, bolts and nuts, as in FIG. 6.

The short spacer 46 is a hollow cylinder that is sandwiched between the two plates 40, 42. It is positioned adjacent to the attachment end 48 so that there is an aperture 60 between the aperture end 66 of the long spacer 44 and the short spacer 46. The short spacer 46 is removably secured in place between the plates 40, 42 by a bolt 78 extending though the short spacer bore 82 and aligned holes 84 in the plates 40, 42 adjacent to the aperture end attachment end 48. A nut 80 turns onto the bolt 78 to secure the short spacer 46. Preferably, the bolt 78 is a low-profile bolt and a round recess 86 in one plate 42 for the head of the bolt 78 streamlines the profile of the folding grappling hook 10. Preferably, the nut 80 is a nylock nut and, optionally, a hexagonal recess 88 in the other plate 40 keeps the nut 80 from turning and streamlines the profile of the folding grappling hook 10.

The blade 12 is attached to the handle 14 at a hinge 18 so that they freely pivot relative to each other. For the present invention, "freely" means that no manual intervention is needed for the blade to pivot away from the handle; gravity alone provides the necessary force. The present invention contemplates any type of hinge mechanisms by which this can be accomplished.

In a first configuration of hinge mechanism, illustrated in most of the figures, particularly FIG. 5, a pair of axially aligned circular collars 120 extend perpendicularly in opposite directions from the blade body 20 adjacent to the hinge end 22. Optionally, the body 20 has a through hole 122 in the center of the collars 120 that is axially aligned with the collars 120. The collars 120 can be formed as integral components of the blade 12 or can be formed as separate tubes that are press fit or otherwise permanently attached in the through holes 122.

Prior to installing the rivets 70, the blade collars 120 are inserted into round hinge holes 124 in the plates 40, 42 adjacent to the rounded hinge end 50. When the rivets 70 are installed, the collars 120 are captured in the hinge holes 124, thereby forming the hinge 18. The diameter of the collars 120 is slightly smaller than the diameter of the hinge holes 124 so that the collars 120 pivot freely within the hinge holes 124. A raised ridge 126 around the hinge hole 124 protrudes from the outer surface 52 of the plates 40, 42 and provides a larger surface area for the collars 120 to pivot on.

In a second configuration of hinge mechanism, shown in FIG. 6, a pair of axially aligned circular collars 130 extend perpendicularly inwardly from the plates 40, 42 adjacent to the hinge end 50. Optionally, the plates 40, 42 have through holes 132 in the center of the collars 130 that are axially aligned with the collars 130. The collars 130 can be formed as integral components of the plates 40, 42 or can be formed as separate tubes that are press fit or otherwise permanently attached in the through holes 132.

Prior to installing the rivets 70, the plate collars 130 are inserted into a round hinge hole 134 in the blade 12 adjacent to the hinge end 22. When the rivets 70 are installed, the collars 130 are captured in the hinge hole 134, thereby forming the hinge 18. The diameter of the collars 130 is slightly smaller than the diameter of the hinge hole 134 so that the collars 130 pivot freely within the hinge hole 134.

Figure 7:
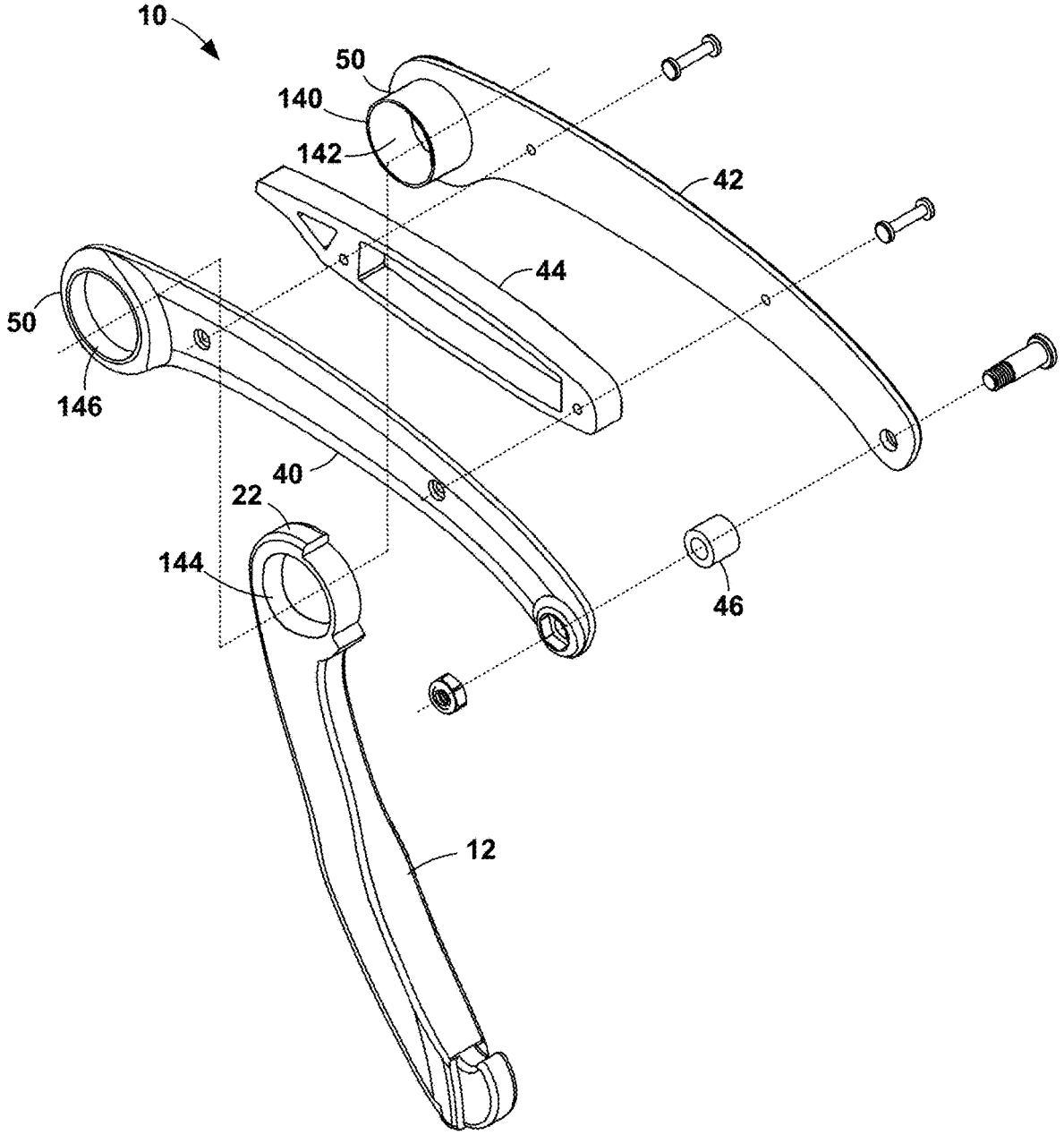
FIG. 7 is an exploded, perspective view of the folding grappling hook with a third configuration of the hinge.

In a third configuration of hinge mechanism, shown in FIG. 7, a circular collar 140 extends perpendicularly inwardly from one of the plates 42 adjacent to the hinge end 50. Optionally, the plate 42 has a through hole 142 in the center of the collar 140 that is axially aligned with the collar 140. The collar 140 can be formed as an integral components of the plate 42 or can be formed as a separate tube that is press fit or otherwise permanently attached in the through hole 142.

Prior to installing the rivets 70, the plate collar 140 is inserted into a round hinge hole 144 in the blade 12 adjacent to the hinge end 22 and a round hinge hole 146 in the other plate 40 adjacent to the hinge end 22. When the rivets 70 are installed, the collar 140 is captured in the hinge holes 144, 146, thereby forming the hinge 18. The diameter of the collar 140 is slightly smaller than the diameter of the blade hinge hole 144 so that the collar 140 pivots freely within the blade hinge hole 144.

Figure 8:
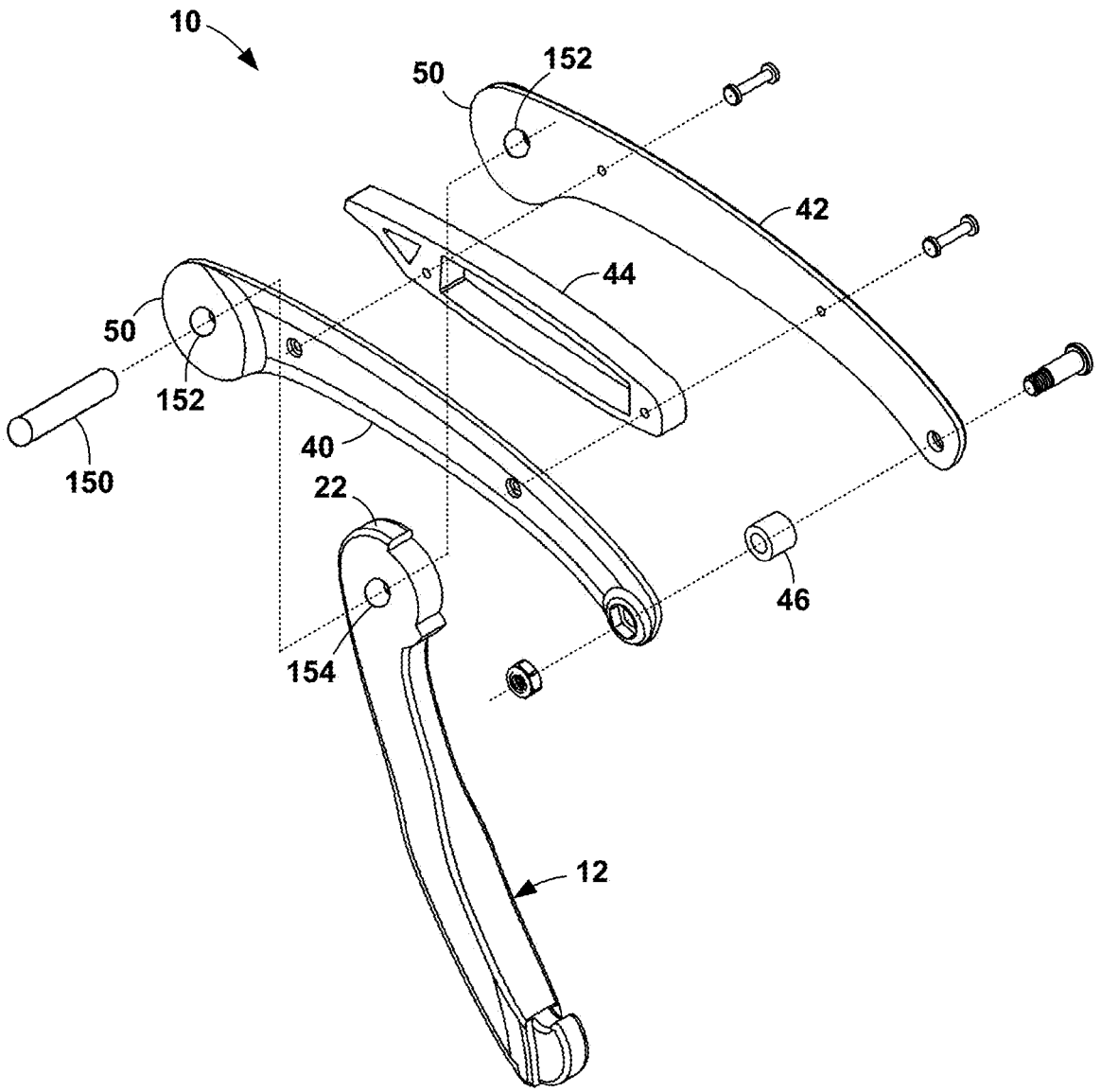
FIG. 8 is an exploded, perspective view of the folding grappling hook with a fourth configuration of the hinge.

Other possible hinge mechanisms employ rods rather than collars in different configurations. In the example configuration of FIG. 8, a rod 150 is pushed through a hinge hole 152 in the hinge end 50 of one plate 40, a hinge hole 154 in the hinge end 22 of the blade 12, and a hinge hole 152 in the hinge end 50 of the other plate 42. The hinge holes 152 are sized so that the rod 150 press fits into the plate hinge holes 152 and so that the blade 12 pivots freely on the rod 150.

In the illustrated folding grappling hook 10, the hinge end 22 of the blade 12 resides between the plates 40, 42. With this arrangement, the folding grappling hook 10 is typically slimmer and simpler to manufacture. The present invention does contemplate that the hinge end 22 of the blade 12 can be notched and that the handle 14 resides within the notch.

Figure 1:
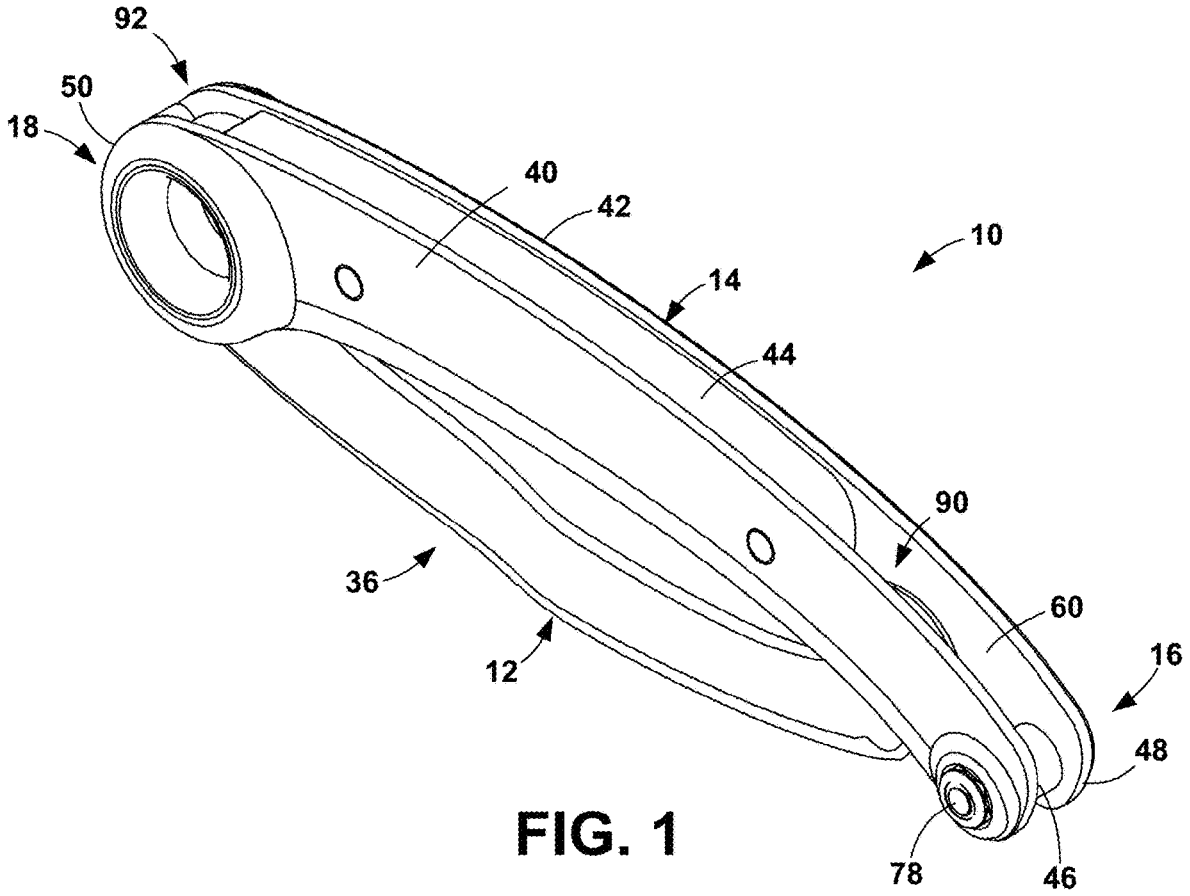
FIG. 1 is a perspective view of the folding grappling hook in the closed configuration.
Figure 2:
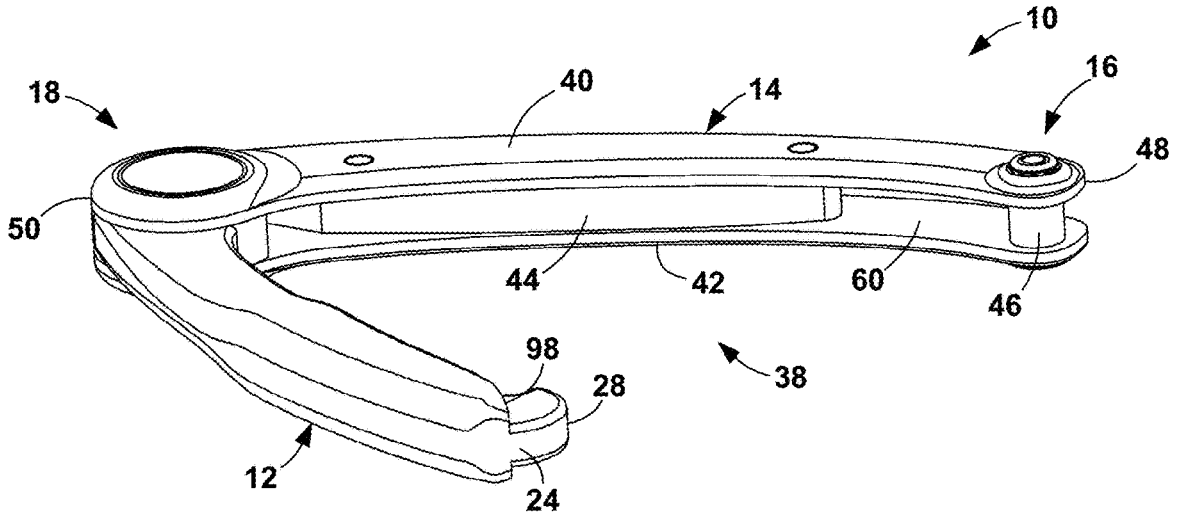
FIG. 2 is a perspective view of the folding grappling hook in the deployed configuration.
Figure 3:
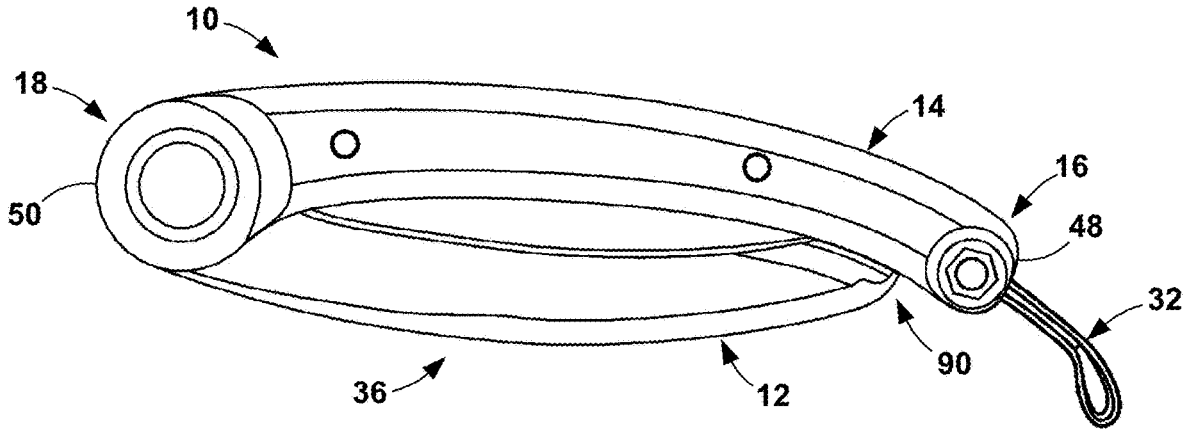
FIG. 3 is a side view of the folding grappling hook in the closed configuration.
Figure 4:
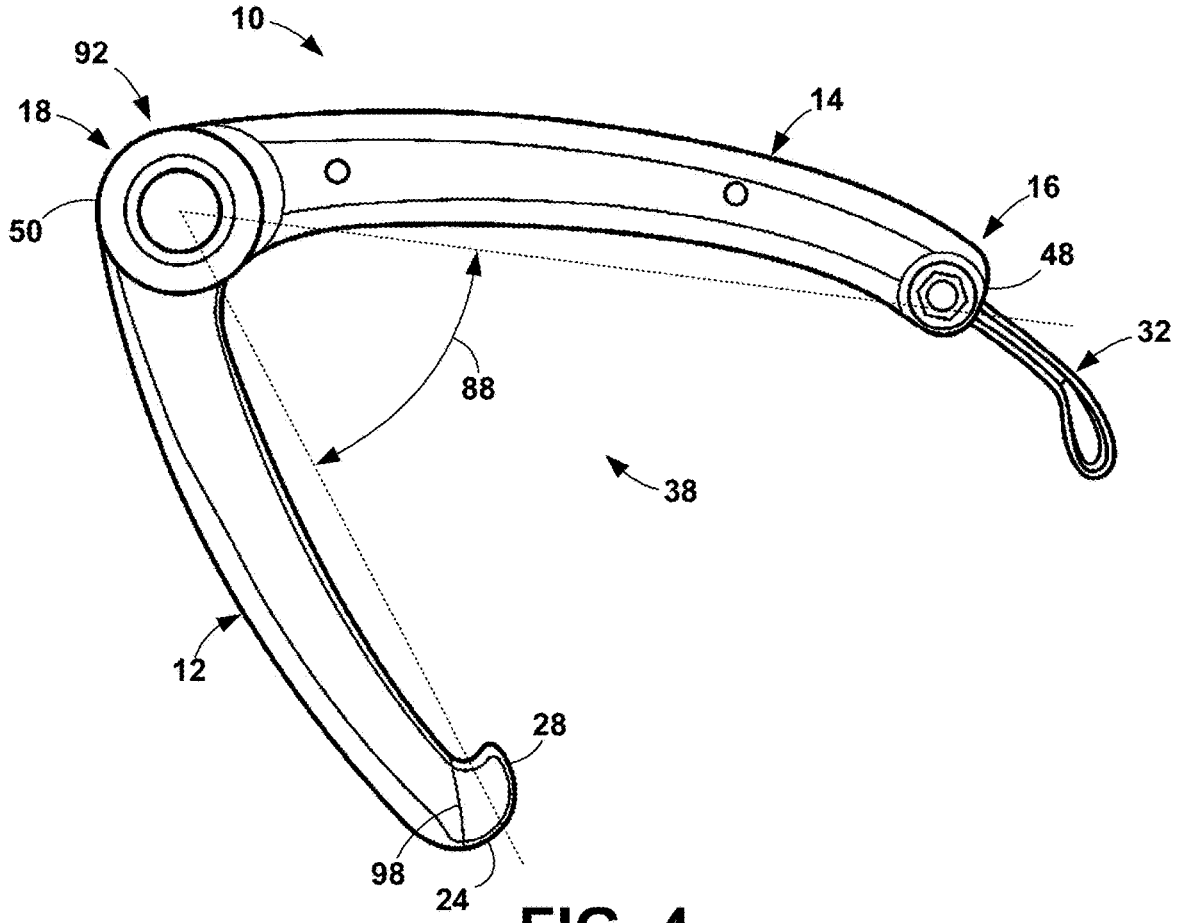
FIG. 4 is a side view of the folding grappling hook in the deployed configuration.

Assuming the handle 14 is stationary, the blade 12 pivots between a closed configuration 36 at a folding stop 90, as in FIGS. 1 and 3, and the deployed configuration 38 at a deployed stop 92, as in FIGS. 2 and 4. In the closed configuration 36, the hook 28 is sheathed within the aperture 60 bounded by the plates 40, 42, the aperture end 66 of the long spacer 44, and the short spacer 46. As can be seen in FIG. 10, the thickness 94 of the hook 28 is slightly smaller than the thickness 62 of the aperture 60 and the thickness 96 of the blade body 20 is slightly larger than the thickness 62 of the aperture 60. These differences allow the hook 28, but not the body 20, to fit into the aperture 60. The discontinuity between the hook thickness 94 and the body thickness 96 forms a shoulder 98 that contacts the two plates 40, 42 to operate as the folding stop 90.

Figure 13:
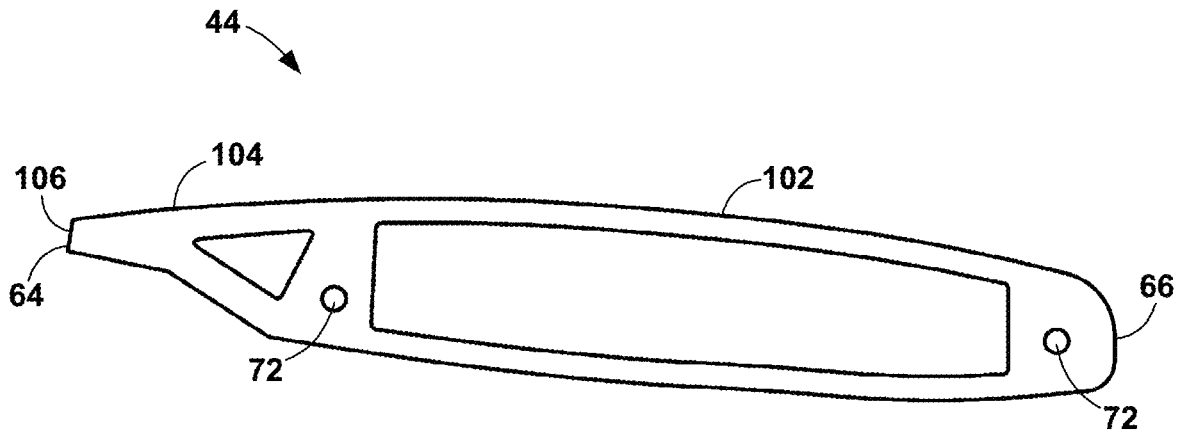
FIG. 13 is a side view of the long spacer.
Figure 14:
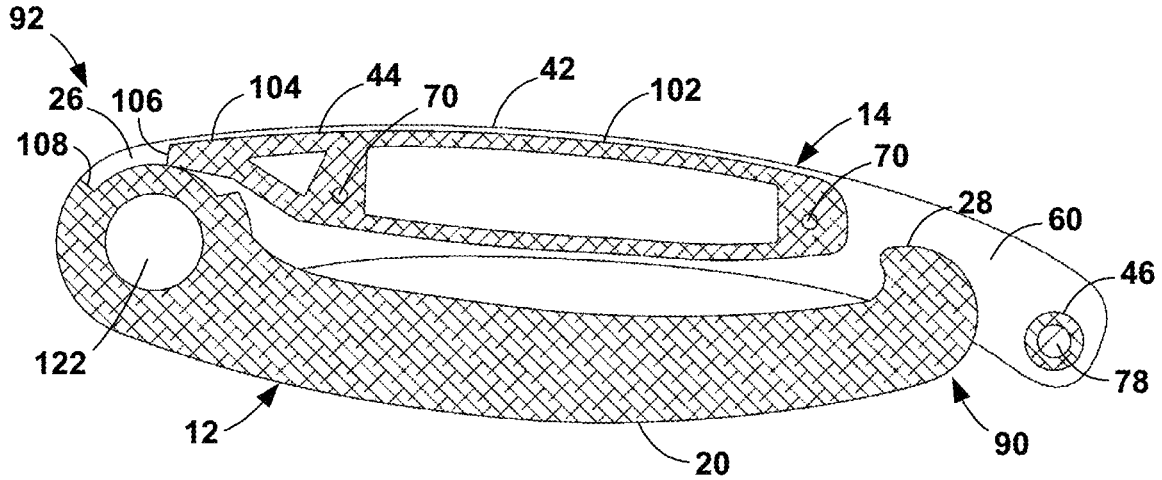
FIG. 14 is a side, cross-sectional view of the folding grappling hook in the closed configuration.

In the deployed configuration 38, the blade 12 is pivoted out of the handle 14 to an angle 88 in the range of from 40° to 90°, with a preferred range of 50° to 65° and a preferred angle of about 55°. Too little angle and the folding grappling hook will fit over many branches. Too much angle and the will not hook many branches. The deployed stop 92 prevents the blade 12 from pivoting further than desired from the handle 14. As seen in FIG. 13, the stop end 64 of the long spacer 44 is at the end of a finger 104 extending generally longitudinally from the main body 102 of the long spacer 44. When the folding grappling hook 10 is assembled, the finger 104 engages with the circumferential groove 26 in the hinge end 22 of the blade 12. As the blade 12 pivots away from the handle 14, the groove 26 rotates relative to the finger 104 until the end 106 of the finger 104 contacts the end 108 of the groove 26. The finger end 106 contacting the groove end 108 operates as the deployed stop 92, preventing the blade 12 from pivoting farther out of the handle 14.

A line is attached to the folding grappling hook 10 at the attachment 16 at the attachment end of the handle 14. The attachment 16 can take any number of forms. In one form, the line is tied around the short spacer 46. In another form, the line is tied to a carabiner, which is then clipped to the short spacer 46. In another form, shown in FIGS. 3 and 4, a lanyard 32 is attached to the short spacer 46 and the line is attached to the lanyard 32 either itself or via a carabiner. The lanyard 32 can be removed or replaced by removing the bolt 78 and nut 80 and sliding the short spacer 46 from between the plates 40, 42.

As currently designed, the folding grappling hook 10 is 290 mm long at its largest dimension, from the handle hinge end 50 to the handle attachment end 48. The blade 12, plates 40, 42, and spacers 44, 46 are composed of an aluminum alloy and, as a consequence, the folding grappling hook 10 is relatively light, coming in at 670 g. The rivets 70, bolt 78, and nut 80 are stainless steel. The present invention contemplates that folding grappling hook 10 can be composed of other materials and can be different sizes appropriate for different applications.

When deploying, the folding grappling hook 10 with the line attached is thrown to fly through the tree canopy in the closed configuration 36, allowing it to fit into tight and small areas. Once the folding grappling hook 10 has landed on a tree branch, it unfolds to the deployed configuration 38 by its own weight and snags on the branch. To retrieve the folding grappling hook 10, the line attached to the folding grappling hook 10 is twisted until the folding grappling hook 10 flips on its back and folds together under its own weight.

Thus, it has been shown and described a folding grappling hook. Since certain changes may be made in the present disclosure without departing from the scope of the present invention, it is intended that all matter described in the foregoing specification and shown in the accompanying drawings be interpreted as illustrative and not in a limiting sense.

The invention claimed is:

1. A folding grappling hook comprising:

(a) a blade with a body, a blade hinge end, and a hook end, the hook end having an inwardly curving hook;

(b) a handle with a handle hinge end and an attachment end, the handle having two parallel plates, a long spacer, and a short spacer, the long spacer sandwiched between, abutting, and secured to the two parallel plates, the short spacer sandwiched between, abutting and secured to the two parallel plates, the handle having an aperture bounded by the plates, the long spacer, and the short spacer;

(c) the blade and handle pivotally attached to each other at a hinge to freely pivot relative to each other between a closed configuration wherein the hook is sheathed within the aperture and a deployed configuration wherein the blade and handle are pivoted away from each other to a deployed stop between 40° and 90°.

2. The folding grappling hook of claim 1 wherein the blade curves inwardly toward the handle and the handle curves inwardly toward the blade.

3. The folding grappling hook of claim 1 wherein the hook curves inwardly toward the handle between 60° and 120°.

4. The folding grappling hook of claim 1 wherein the deployed stop includes a circumferential groove at the blade hinge end and a finger extending from the long spacer to engage with the groove, whereby, as the blade pivots relative to the handle, the groove rotates relative to the finger until the finger contacts an end of the groove thereby preventing the blade from pivoting farther out of the handle.

5. The folding grappling hook of claim 1 wherein the hinge end of the blade resides between the handle plates.

6. The folding grappling hook of claim 1 wherein the hinge includes circular collars extending perpendicularly in opposite directions from the blade adjacent to the blade hinge end and that fit into openings in the handle plates adjacent to the handle hinge end.

7. The folding grappling hook of claim 1 wherein the long spacer is permanently secured between the plates and the short spacer is removably secured between the plates.

8. The folding grappling hook of claim 1 wherein the hook is narrower than the blade body forming a shoulder, the shoulder contacting the handle plates operating as a folding stop.

9. A folding grappling hook comprising:

(a) a blade with a body, a blade hinge end, and a hook end, the hook end having a hook curving inwardly toward the handle between 60° and 120°;

(b) a handle with a handle hinge end and an attachment end, the handle having two parallel plates separated by a long spacer permanently secured therebetween and a short spacer removably secured therebetween, and with an aperture bounded by the plates, the long spacer, and the short spacer;

(c) the blade and handle pivotally attached to each other at a hinge with the hinge end of the blade between the handle plates, to freely pivot relative to each other between a closed configuration at a folding stop wherein the hook is sheathed within the aperture and a deployed configuration wherein the blade and handle are pivoted away from each other to a deployed stop between 40° and 90°.

10. The folding grappling hook of claim 9 wherein the blade curves inwardly toward the handle and the handle curves inwardly toward the blade.

11. The folding grappling hook of claim 9 wherein the deployed stop includes a circumferential groove at the blade hinge end and a finger extending from the long spacer to engage with the groove, whereby, as the blade pivots relative to the handle, the groove rotates relative to the finger until the finger contacts an end of the groove thereby preventing the blade from pivoting farther out of the handle.

12. The folding grappling hook of claim 9 wherein the hinge includes circular collars extending perpendicularly in opposite directions from the blade adjacent to the blade hinge end and that fit into openings in the handle plates adjacent to the handle hinge end.

13. The folding grappling hook of claim 9 wherein the hook is narrower than the blade body forming a shoulder, the shoulder contacting the handle plates operating as the folding stop.

* * * * *